US006270422B1

(12) United States Patent
Fisher

(10) Patent No.: US 6,270,422 B1
(45) Date of Patent: Aug. 7, 2001

(54) GOLF PUTTER WITH TRAILING WEIGHTING/AIMING MEMBERS

(76) Inventor: Dale P. Fisher, 18055 Bushard, Fountain Valley, CA (US) 92708

( * ) Notice: Subject to any disclaimer, the term of this patent is extended or adjusted under 35 U.S.C. 154(b) by 0 days.

(21) Appl. No.: 09/344,470

(22) Filed: Jun. 25, 1999

(51) Int. Cl.[7] ..... A63B 57/00; A63B 69/36

(52) U.S. Cl. ..... 473/223; 473/226; 473/251; 473/340; 473/341

(58) Field of Search ..... 473/223, 226, 473/251, 340, 341, 342, 242

(56) References Cited

U.S. PATENT DOCUMENTS

| | | | | |
|---|---|---|---|---|
| D. 408,878 | * | 4/1999 | Patten | D21/743 |
| 4,741,535 | * | 5/1988 | Leonhardt | 273/164 |
| 5,197,737 | * | 3/1993 | Desbiolles et al. | 273/167 R |
| 5,308,067 | * | 5/1994 | Cook | 273/164.1 |
| 5,830,078 | * | 11/1998 | McMahan | 473/252 |

* cited by examiner

*Primary Examiner*—Jeanette Chapman
*Assistant Examiner*—Sneh Varma

(74) *Attorney, Agent, or Firm*—William L. Chapin

(57) ABSTRACT

A golf putter which aids a golfer in aiming a putt and avoiding twisting of the shaft in the hand during a swing includes a head provided with a pair of laterally spaced apart trailing members which protrude rearwardly of the rear surface of the head and function cooperatively as weighting/aiming members. The trailing members are preferably located equidistant from a vertical center plane through the sweet spot of the head and have in plan view longitudinally directed visual features perpendicular to the front ball-impacting face of the head, which assist a golfer in visually framing an intended initial ball trajectory to a target hole on a golf green, along with a ball impact vector perpendicular to the center of percussion or sweet spot of the head. Each of the trailing members is preferably laterally symmetric, and may include a longitudinal index line marked on the upper surface of the member, to facilitate visual framing of a putt. Each of the trailing weighting/aiming members is preferably removably fastenable in a pre-determined position to the rear surface of the putter head, and may consist of a hollow shell which contains a core weighting member which may be selected from a variety of weights, thereby affording means to adjust the heel-to-toe weight distribution characteristics of the putter to suit a golfer's preference.

33 Claims, 4 Drawing Sheets

GOLF PUTTER WITH TRAILING WEIGHTING/AIMING MEMBERS

BACKGROUND OF THE INVENTION

A. Field of the Invention

The present invention relates to golf clubs used in the game of golf. More particularly, the invention relates to an improved putter having a head construction which assists a golfer swinging the putter to impact a ball, in aligning the impact vector of the club head with a hole and maintaining the club head face perpendicular to the impact vector.

B. Description of Background Art

A number of prior art references disclose golf putters in which the head of the putter has structural elements that direct the eye towards the "sweet-spot" on the face of the putter. The "sweet-spot" is a relatively small area on the face of a club which overlies the center of percussion of the club head, i.e., that location at which a golf ball may be impacted without producing a torque about the hosel and shaft of the club.

Other prior art references disclose golf putter heads in which the heel and toe portions of the head are heavier than the center portion, to thereby increase the polar moment of inertia of the head over that of a head with uniform heel-to-toe weight distribution. A large polar moment of inertia is desirable because it resists any tendency of a golfer to twist the club shaft as it is swung forward to impact a ball, thus helping to insure that the club face will impact the ball squarely rather than obliquely. This in turn insures that the momentum vector imparted to the ball upon impact does not angle away from the impact momentum vector of the club head, which corresponds to an intended initial ball trajectory chosen by the golfer. Some prior art references disclose putter heads having a construction which incorporates both sweet-spot targeting visual features as well as heel and toe biased weighting.

References known by the present inventor to incorporate either or both characteristics discussed above include the following U.S. patents.

Winter, U.S. Pat. No. 3,921,984, Nov. 25, 1975, Clubhead Having Alignment Means And High Moment of Inertia Spaced From Center Of Gravity Thereof Discloses a putter head with a rear portion angled obliquely outwardly and rearwardly to concentrate mass of the club head at higher radial distances from the geometric center/center of gravity of the head, to thereby increase the polar moment inertia from that of a head having a uniform transverse section. The obliquely angled rear surfaces protrude beyond the rear face of the club as a pair of symmetric fins resembling a bat-wing aircraft, and the head includes a center fin which protrudes perpendicularly rearwardly with respect to the front impacting face of the club, and forms with the wings in plan view an arrow-shaped structure pointed at the sweet-spot on the front face of the head, to facilitate alignment of the sweet-spot with the intended direction of travel of the ball.

Nelson, U.S. Pat. No. 5,127,653, Jul. 7, 1992, Golf Putter

Discloses a golf putter having a head with opposite heel and toe sections which are divergent rearwardly to draw the golfer's visual alignment to the sweet-spot. A cavity centrally positioned at the rear of the face is configured to resemble a part of the surface of a golf ball to remove weight and provide an additional visual putting alignment guide. The putter has an offset hosel which is adjustably secured to the head at assembly so precise face balancing can be achieved before final permanent assembly of the components.

Montgomery, III, U.S. Pat. No. 5,167,414, Dec. 1, 1992, Golf Putter

Discloses a golf putter head which is cast in one piece and comprises a face plate including a striking surface adapted to strike a golf ball with a sole plate extending rearwardly from the face plate at the lower end having an arcuate lower surface which is designed to accommodate golfers of different heights, an upper weighting member, spaced above the sole plate also extends rearwardly of the face plate and is constructed so as to provide two rearwardly projecting wing members which define a V-shaped recess having a bight which is essentially perpendicular to the striking face of the face plate, and a line or score mark is defined on the weighting member which is essentially perpendicular to the striking surface of the face plate to aid the golfer in aligning the putt. The weight distribution between the sole plate and the upper weighting member is such as to impart overspin to a golf ball and thereby insure that the ball rolls when struck and does not slide nor skid over a green.

Kinoshita, U.S. Pat. No. 5,131,656, Jul. 21, 1992, Impulse Performance Putter

Discloses a golf putter head having one mass section located directly behind the golf ball impact point and two other mass sections used for heel-toe weighting of the putter head. Two high moment of inertia structures are used to rigidly connect the mass section located directly behind the impact point to the heel-toe weighting mass sections. The high moment of inertia structures ensure that maximum momentum transfer to the golf ball is realized from the momentum of the heel-toe mass sections at impact.

The prior art references listed above disclose golf putters in which the heads are constructed in a manner intended to assist a golfer in impacting a ball with the sweet-spot of the putter head face by means of visual alignment elements directed toward the sweet-spot, avoid twisting the club shaft during a swing by increasing the polar moment of inertia of the head, or both. However, the prior art known to the present inventor fails to solve the following two problems that are related to visual alignment and shaft twisting, respectively.

First, while prior art visual alignment aids may assist in impacting a ball with the sweet-spot of a club head face, there remains the equally if not more important problem of aligning the impact vector with a hole which may be many feet away. Furthermore, if a green is not absolutely level, the golfer may have to aim the ball impact vector at a point laterally displaced from the hole, so that the initial velocity vector of the impacted ball in combination with the roll characteristics of the green will result in a curved ball trajectory terminating at the hole. Therefore, it can be readily appreciated that merely impacting the ball with the sweet-spot of the club head will not insure that the ball will go into the hole.

Second, with respect to shaft twisting, a putter head having a large polar moment of inertia will counter a tendency of the head to twist about an axis directed through the center of gravity of the head. Thus, this construction is effective for putters in which the axis of the shaft is aligned with the center of gravity, i.e., a face-balanced club. However, many golfers prefer a putter construction in which the hosel and shaft are laterally offset a substantial distance from the center of gravity of the putter head to locate the hosel near the heel of the head. With this construction, the longitudinal axis of the shaft typically intersects the horizontal mid-plane of the head at a location closer to the heel than the toe; therefore, the moment arm of the toe portion of the head about the shaft axis is greater than that of the heel portion. This weight offset can result in a torque tending to twist the toe rearward as the club is swung forward.

The present invention was conceived of to provide a putter construction which facilitates aiming the trajectory of an impacted ball in a desired direction, and which permits adjusting the relative magnitudes of the heel and toe weight moments about the shaft axis, to thereby control the magnitude and direction of torques tending to twist the putter shaft in the hand when the putter is swung.

OBJECTS OF THE INVENTION

An object of the present invention is to provide a golf putter in which the putter head is provided with a pair of laterally spaced apart, rearwardly protruding adjustable weighting members located on opposite sides of the sweet-spot of the head, to adjust the relative magnitudes of the heel and toe weight moments about the shaft axis.

Another object of the invention is to provide a golf putter including a head having a pair of laterally opposed trailing weighting members located equidistant from the sweet-spot of the head.

Another object of the invention is to provide a golf putter including a shaft attached to a head provided with a pair of laterally spaced apart trailing weighting/aiming members, each consisting of an external shell in which weighting components having different weights may be held, thus permitting adjustment of the relative magnitudes of heel and toe weight moments about the shaft axis.

Another object of the invention is to provide a golf putter including a head having a pair of trailing weighting/aiming members which may be readily interchangeable with weighting/aiming members having different, unequal weights by a golfer, or removed entirely.

Various other objects and advantages of the present invention, and its most novel features, will become apparent to those skilled in the art by perusing the accompanying specification, drawings and claims.

It is to be understood that although the invention disclosed herein is fully capable of achieving the objects and providing the advantages described, the characteristics of the invention described herein are merely illustrative of the preferred embodiments. Accordingly, I do not intend that the scope of my exclusive rights and privileges in the invention be limited to details of the embodiments described. I do intend that equivalents, adaptations and modifications of the invention reasonably inferable from the description contained herein be included within the scope of the invention as defined by the appended claims.

SUMMARY OF THE INVENTION

Briefly stated, the present invention comprehends a golf putter club in which the head of the putter incorporates novel structural features which aid a golfer in aiming a ball impacted by the putter head along a desired trajectory, and which enable the golfer to readily adjust heel-toe weight distribution of the head.

According to one aspect of the invention, a golf putter head is provided with a pair of laterally spaced apart members which each protrude rearwardly from a rear surface of the head and function cooperatively as trailing weighting/aiming members. To accomplish the aiming function, the trailing weighting/aiming members are preferably located equidistant from a vertical center plane through the sweet-spot of the head and have in plan view longitudinally directed visual features which are perpendicular to the front face of the club head. These features facilitate visual framing of a target cup or hole on a golf course green along with the sweet-spot and, thereby aligning the ball impact vector with a chosen initial trajectory towards the cup. In a preferred embodiment, the visual features consist of a vertical symmetry plane perpendicular to the front face of the club head, on each of a pair of laterally symmetrically shaped trailing weighting/aiming members. Viewability of the vertical symmetry planes may be enhanced by a longitudinal index line marked on the upper surface of each trailing weighting/aiming member, at a location corresponding to the vertical symmetry plane thereof.

According to another aspect of the invention, the trailing/weighting members have weight characteristics which afford a capability for adjusting both the magnitude of the polar moment of inertia of the putter head about its center of gravity, as well as the relative magnitudes of the heel and toe weight moments about the shaft axis.

According to another aspect of the invention, a golf putter head is provided with a pair of laterally opposed trailing weighting/aiming members located equidistant from a longitudinal medial plane through the center of gravity of the head, the members having similar or identical shapes which facilitate framing a putt to an intended target cup, but which may each have a different weight, thus allowing adjustment not only of the polar moment of inertia of the head, but also allowing the center of gravity of the head to be shifted laterally towards the heel or toe of the club head, as desired.

DESCRIPTION OF THE PREFERRED EMBODIMENTS

FIGS. 1–7 illustrate a golf putter with trailing weighting/aiming members according to the present invention. In the example embodiment of the invention shown in FIGS. 1–7, the putter is of a type commonly referred to as a "blade putter," that title derived from the fact that the head of a putter of this type usually has a laterally elongated, relatively thin shape. Another type of putter in widespread use is commonly referred to as a "mallet" type putter, owing to the fact that putter heads of this type have a relatively thick, bulbous head vaguely reminiscent of a croquet or woodworker's mallet. However, as will be evident to those skilled in the art, the novel and advantageous features of an improved putter in which the head of the putter is provided with trailing weighting/aiming members according to the present invention are applicable to various types of putters including mallets as well as blades.

Figure 1:
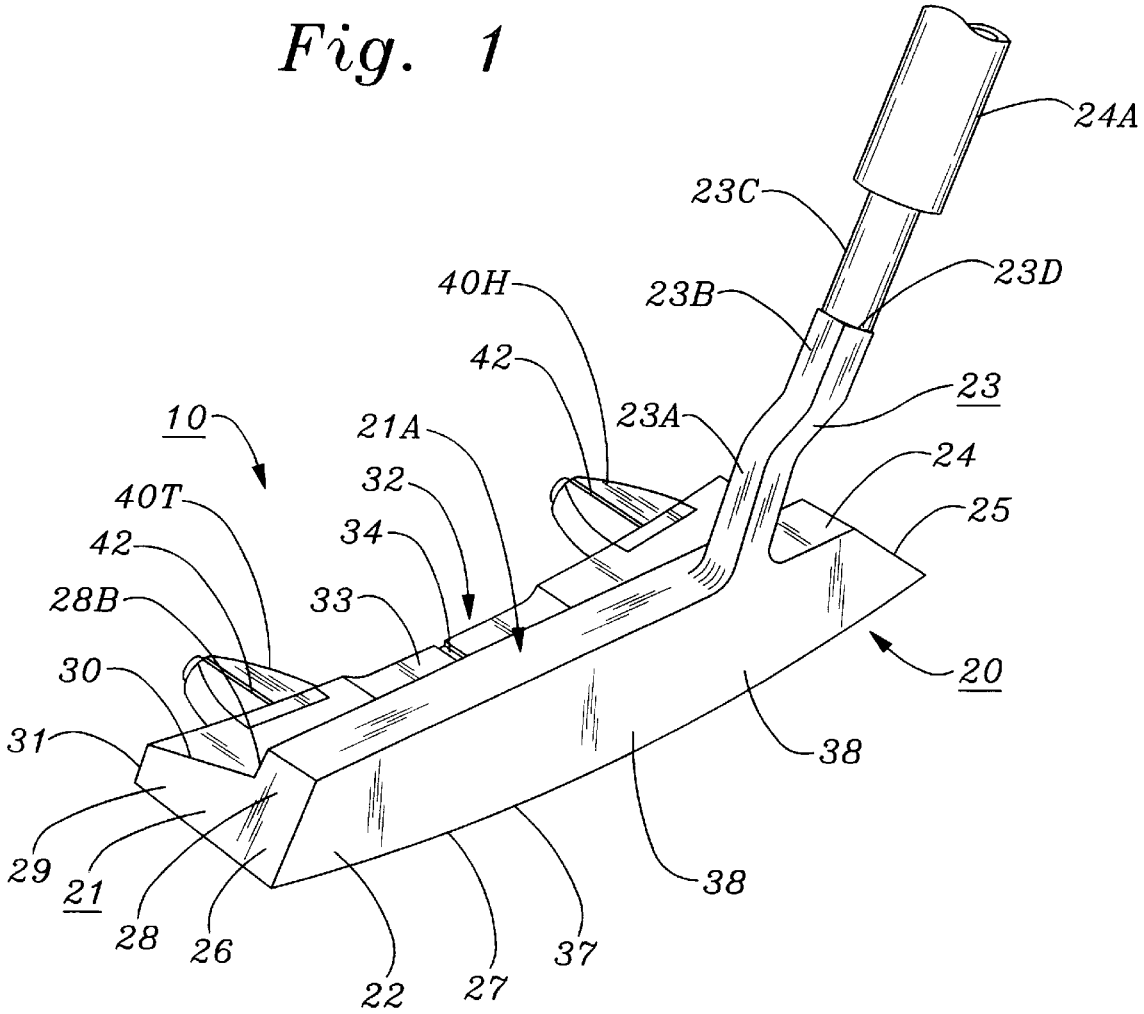
FIG. 1 is a perspective view of a golf putter with trailing weighting/aiming members according to the present invention.

Referring now to FIG. 1, a gold putter 10 with trailing weighting/aiming members according to the present invention may be seen to include a head 20 comprising a laterally elongated body 21 including a front, generally vertically disposed blade portion 21A having a generally flant front face 22 adapted to impact a golf ball. Front face 22 is disposed upwardly from a lower surface or sole 27 of putter head body in an approximately perpendicular direction, but may be tilted backward or forward slightly to a desired position or negative loft angle, respectively.

Putter head body 21 has an elongated, generally cylindrically-shaped shank 23 that protrudes upwardly fromthe upper wall 24 of front blade portion 21A of the body. As shown in FIG. 1, shank 23 joins upper wall 24 of front blade portion 21A of body 21 at a location offset laterally from the center of the front face, near the right side wall 25 of the body. As is also shown in FIG. 1, in front elevation view, shank 23 has a lower portion 23A that protrudes substantially vertically upwards from upper wall 24 of front blade portion 21A of body 21, and intermediate and upper portions 23B and 23C, respectively, that angle laterally away from a vertical center line through the body.

Figure 3:
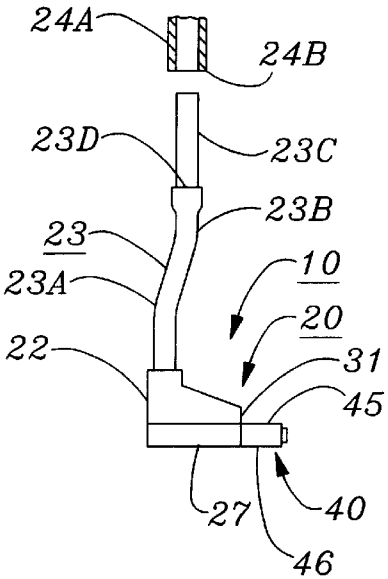
FIG. 3 is a right side elevation view of the putter head of FIG. 2.

As may be seen best by referring to FIG. 3, in side elevation view, lower portion 23A of shank 23 angles sinuously rearward from the front face 22 of body 21, while intermediate portion 23B bends rearward to join upper portion 23C, the latter two portions lying in a laterally disposed vertical plane.

As shown in FIGS. 1 and 3, upper portion 23C of shank 23 has a circular cross section which is adapted to be insertably received within the bore of a tubular golf club shaft 24A. Preferably, upper cylindrical portion 23C of shank 23 is of smaller diameter than the adjacent part of intermediate portion 23B of the shank and is joined thereto by an annular shoulder 23D. Shoulder 23D provides a seating surface for the lower annular wall surface 24B of golf club shaft 24A, which insertably receives shank 23.

As may be seen best by referring to FIG. 1, body 21 of putter head 20 includes a rear web portion 29 that protrudes rearwardly from front blade portion 21A of the body. Rear web portion 29 of putter head body 21 has a generally trapezoidal cross-sectional shape, including a base formed by the a generally flat, convexly curved lower wall surface or sole 27.

Figure 4:
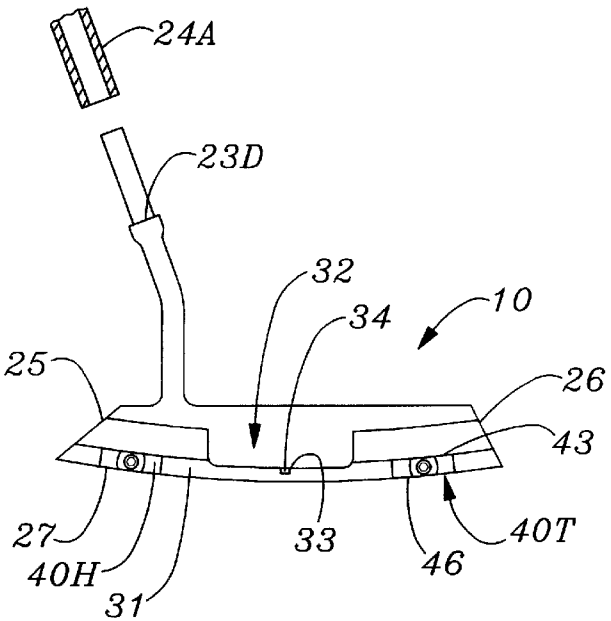
FIG. 4 is a rear elevation view of the putter head of FIG. 2.

As shown in FIGS. 1, 3 and 4, front blade portion 21A of putter head body 21 has an upper laterally disposed rectangular cross section rib portion 28 protruding downwards from upper wall surface 24 of the body. Trapezoidal cross-section rear web portion 29 of body 21 has an upper wall 30 that intersects rear wall 28B of rib portion 28 below upper surface 24, the upper wall sloping downwards and rearwards to intersect rear vertical wall surface 31 of the rear web portion of the body.

As may be seen best by referring to FIGS. 1 and 4, a laterally elongated, medial portion of rear web portion 29 of putter head body 21 is relieved downwards from sloping upper wall 30 to form a notch 32. The lower wall surface 33 of notch 32, which forms with lower wall surface 27 of body 21 a thinner web, preferably has marked thereon a longitudinally disposed indicator or index line 34. Index line 34 is parallel to and midway between right and left side walls 25 and 26 of body 21. Thus, index line 34 is perpendicular to the center of the putter sweet-spot, and signifies to a golfer the ideal spatial orientation of the club head impact vector relative to the center of a golf ball.

Figure 2:
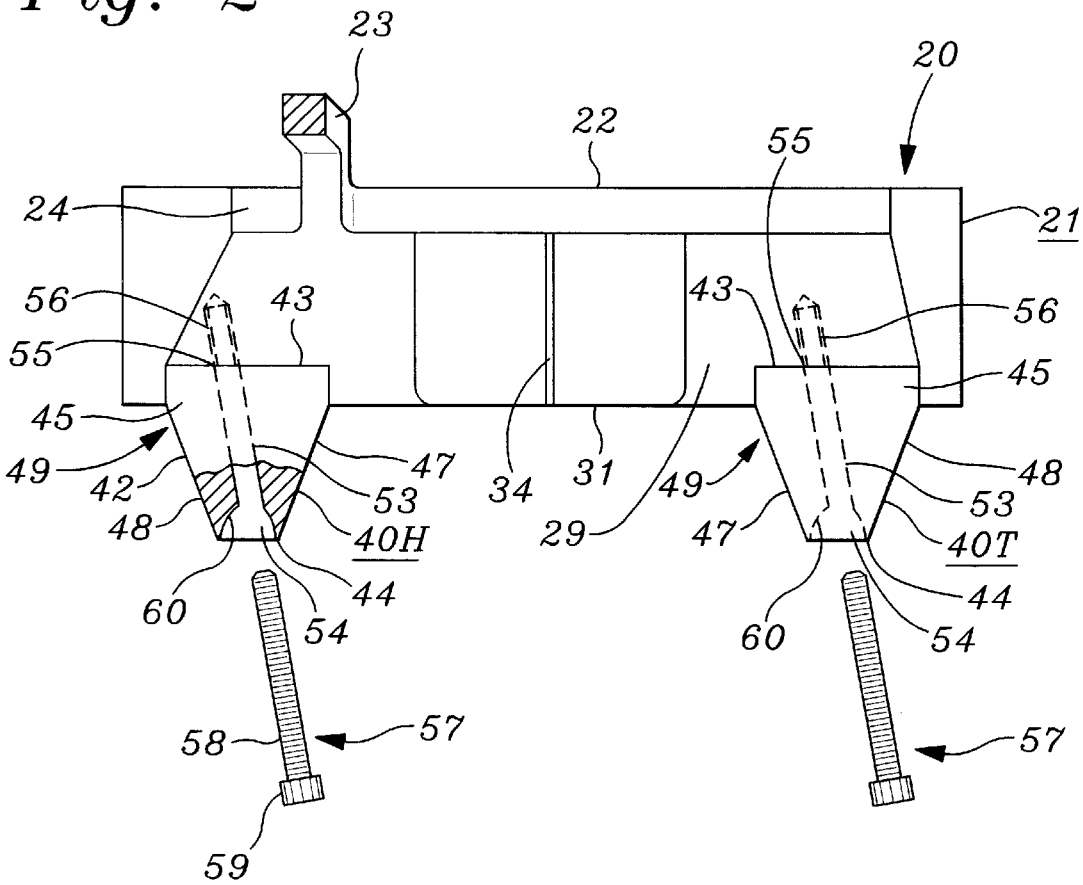
FIG. 2 is a fragmentary upper plan view of the putter of FIG. 1, showing the head thereof.
Figure 6:
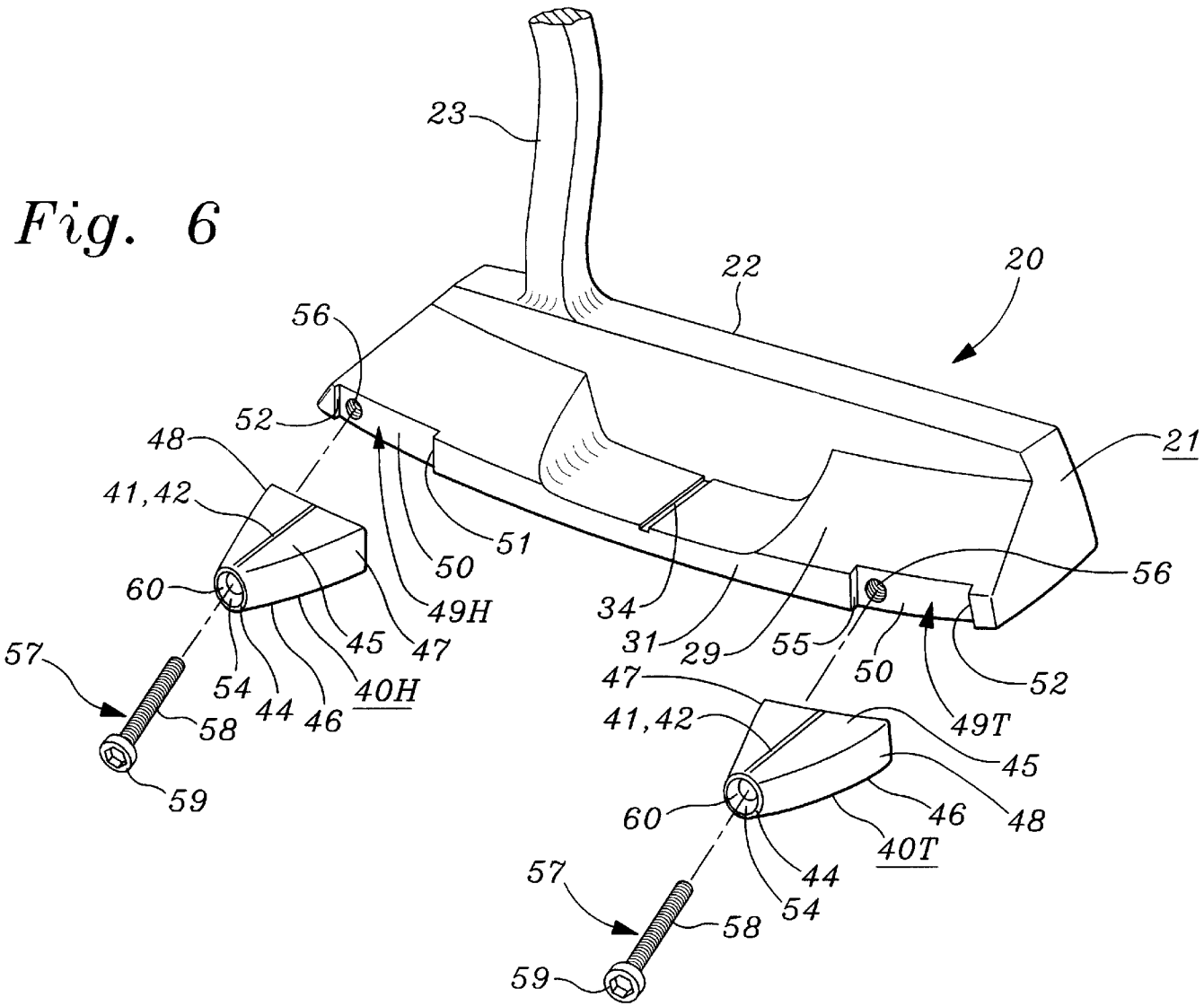
FIG. 6 is an exploded rear perspective view of the putter head of FIG. 2.

Referring now primarily to FIGS. 1, 2 and 6, it may be seen that golf putter head 20 according to the present invention includes a pair of trailing weighting/aiming members 40 that protrude rearwardly from body 21 of the putter head. In the example embodiment of putter head 20 shown in the figures, trailing weighting/aiming members 40 protrude from rear vertical wall surface 31 of rear web portion 29 of putter head body 21. However, as may be clearly understood from the ensuing description of the structure and function of trailing weighting/aiming members 40, they could protrude rearwardly from other portions of a putter head body.

As may be seen best by referring to FIG. 2, trailing weighting/aiming members 40 comprise a laterally spaced apart pair in which each of the members is spaced equidistant from a vertical longitudinal center plane of front face 22 of putter head body 21, the trace of which center plane coincides with sweet-spot indicating index line 34. As is also shown in FIG. 2, trailing weighting/aiming members 40 preferably have a laterally symmetric shape, so that a golfer viewing the members from above may mentally visualize a separate vertical symmetry plane penetrating the upper surface of each of the two members, thus forming two imaginary "outboard framing lines" 41 equidistant from the sweet-spot and directed perpendicularly forward towards front face 22 of putter head body 21. The two imaginary framing lines assist the golfer in forming an image which includes not only the alignment of sweet-spot index line 34 with a ball prior to impact, but which also encompasses between the two outboard framing lines a swath of green between the ball and an intended target hole. As shown in FIG. 2, visualization of imaginary outboard framing lines 41 may be enhanced by real outboard index lines 42 painted or inscribed at the locations of the imaginary lines.

Figure 5:
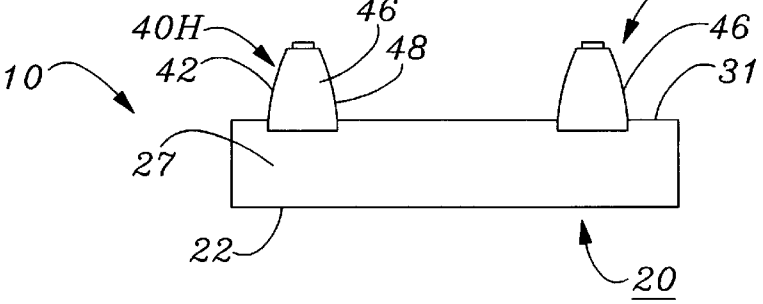
FIG. 5 is a lower plan view of the putter head of FIG. 2.

The structure and method of attachment of trailing weighting/aiming members 40 to putter head body 21 may be best understood by referring to FIGS. 4 and 6. As shown in those figures, trailing weighting/aiming members 40 may comprise a pair of laterally spaced apart, identical appearing left and right or heel and toe members 40H and 40T, respectively. Each member 40 preferably has a laterally symmetric shape, which, in the example embodiment of putter head body 21 shown in the figures, is that of a prism of uniform thickness and having in plan view the shape of an isosceles triangle including a front mounting base 43 and a rear vertex truncated by a rear face 44 parallel to the base. As shown in FIGS. 2, 3 and 5, each weighting/aiming member 40 has generally flat upper and lower triangular-shaped upper and lower wall surfaces 45 and 46, respectively, and outer and inner straight side walls 47 and 48, respectively, which converge rearwardly towards the vertical center plane of the member.

Referring now to FIG. 6, it may be seen that each weighting/aiming member 40 of an example embodiment of a putter head body 21 is removably fastened to rear surface 31 of the web portion 29 of the body. A preferred attachment location of weighting/aiming members 40 is a rear surface of a putter near the lower surface or sole thereof, whether the putter be a blade type as shown in the example embodiment in the figures, or a different type such as a mallet.

As shown in FIG. 6, each trailing weighting/aiming member 40 preferably has a vertical thickness equal to that of rear surface 31 of web portion 29 of putter head body 21, thus providing continuity between the respective upper and lower surfaces of the web portion and trailing weighting/aiming members. As is also shown in FIG. 6, rear wall surface 31 of rear web portion 29 of putter head body 21 preferably has formed therein a pair of laterally elongated, rectangular cross-section notches 49 for receiving the front portions of weighting/aiming members 40. Thus, each of a pair of left and right or heel and toe notches 49H, 49T has a flat transversely disposed front wall 50 on which base 43 of a member 40 may seat, and inner and outer longitudinally disposed, laterally spaced apart walls 51 and 52, adapted to insertably receive therebetween inner and outer walls 47 and 48, respectively, of a trailing weighting/aiming member 40.

Referring still to FIG. 6, it may be seen that putter head 20 is preferably constructed so that each trailing weighting/aiming member 40 may be fastened to putter head body 21 only in a predetermined "keyed" orientation with respect to the body. Thus, as shown in FIG. 6, each trailing weighting/aiming member 40 has therethrough a bore 53 having a rear entrance opening 54 coinciding with the vertex of the triangularly-shaped weighting member, which is disposed in a generally longitudinal direction through the member, but angled laterally away from the longitudinally disposed altitude of the member. Thus, as shown in FIG. 2, bore 53 through each trailing weighting/aiming member 40 has a front exit opening 55 offset laterally from the altitude or center line of the triangularly-shaped member. Also, front wall 50 of each notch 49 in rear web portion 39 of putter head body 21 has protruding forwardly inwardly therefrom an obliquely angled threaded bore 56 which is coaxially aligned with angled bore 53 through trailing weighting/aiming member 40. Constructed in this manner, each trailing weighting/aiming member 40 may be attached to putter head body 21 by a screw 57. Preferably the shank 58 of screw 57 has a socket head 59 which may be recessed in a countersunk enlargement 60 of rear entrance opening 54 of bore 53 through trailing weighting/aiming member 40, flush with rear face 44 of the trailing weighting/aiming member. With the arrangement described above, trailing weighting/aiming members 40 may be removably fastened to putter head body 21 only in a horizontally disposed orientation, as shown in FIGS. 1–5.

Trailing weighting/aiming members 40 may be made of a variety of materials to suit the needs and desires of a particular golfer. Thus, if the weight characteristics of putter 10 are of less concern than the framing/aiming functions performed by members 40, the latter may be made of relatively light weight materials having desired appearance characteristics. For example, with putter head 20 made of a material such as stainless steel having a gray or silvery appearance, trailing members 40 may be made of a material such as brass having a contrasting color and/or texture appearance, thus enhancing viewability of the members while framing a putt.

For applications in which it is desired to increase the polar moment of inertia of putter head 20, trailing members 40 may be made of a high-density material such as tungsten. Moreover, for applications in which it is desired to shift the center of gravity of putter head 20 from its location without trailing members 40 attached to a different location, heel and toe trailing members 40H, 40T may be made of materials having differing densities. An example of this configuration may be seen by referring to FIG. 4, in which putter head body 21 is shown to be laterally symmetrically shaped, thus locating the center of gravity of the body in a longitudinally disposed vertical plane midway between right and left side walls 25 and 26 of the body. As is also shown in FIG. 4, the longitudinal axis of shaft 24A of putter 10 intersects putter head body 21 at a location between the center and right side wall or heel 25 of the body, i.e., inboard from the center of gravity. Therefore, it can be appreciated that the moment arm of the toe or outboard portion of putter head body 21 about the shaft axis may be substantially greater than the moment arm of the heel portion about the shaft axis. As a result, even a small elevation of the toe portion relative to the heel portion during a stroke produces a torque on putter head body 21 which tends to twist the toe portion and shaft backward in the hand of the golfer. For this reason, an individual golfer may wish to readjust the weight distribution of putter head 20 to one which reduces the difference in toe and heel weight moments about the shaft axis. According to the present invention, this adjustment can be accomplished by making outboard, toe trailing member 40T of a relatively light-weight material such as aluminum, and inboard, heel trailing member 40H of a relatively heavier material such as tungsten. Of course, if an individual golfer prefers to increase the magnitude of the toe moment arm relative to the heel moment arm, heel and toe trailing members 40H and 40T may be removed and attached at interchanged position to putter head body 21. Moreover, an individual golfer may wish to use putter 10 with trailing members 40 attached during practice sessions in which the golfer is attempting to improve his or her putting skills, and removing one or both of the trailing members at other times. That capability is offered by putter 10 according to the present invention.

Figure 7:
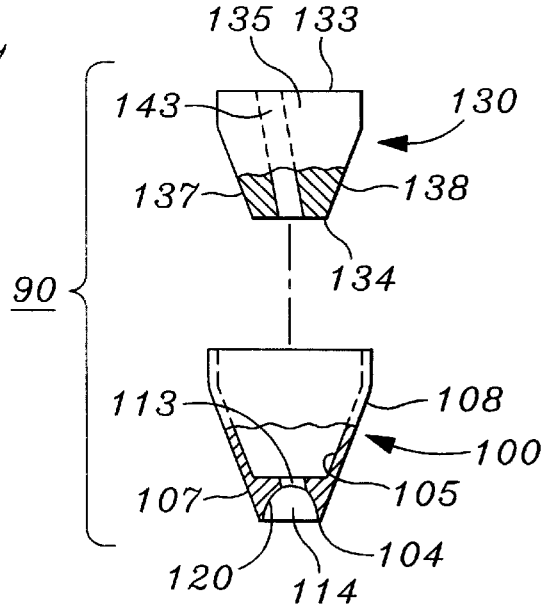
FIG. 7 is an upper perspective view of a modification of a trailing weighting/aiming member for the putters of FIGS. 1 and 2.

FIG. 7 illustrates a modification of a trailing weighting/aiming member for a golf putter according to the present invention.

As shown in FIG. 7, modified trailing weighting/aiming member 90 includes a hollow shell 100 similar in external appearance to member 40 shown in FIGS. 1–6 and described above. Contained within shell 100 is a core weighting member 130 which may be shaped and constructed similarly to shell 100 and trailing weighting/aiming members 40, but of smaller size. With this construction, heel and toe shells 100H, 100T of modified trailing weighting/aiming member 90 may be constructed of identical materials and have identical appearance. However, core weights 120H, 120T may be constructed of different, heavier or lighter materials sch as tungsten or aluminum, to provide desired differential weight distribution characteristics to putter head 80.

What is claimed is:

1. A golf putter head comprising a laterally elongated body having an upper wall surface, a lower, sole surface, a front face for impacting a golf ball, a first, outer longitudinally disposed side wall defining adjacent thereto a toe end portion of said body, a second, inner longitudinally disposed side wall defining adjacent thereto a heel end portion of said body, a rear wall surface, and at least a first trailing member removably attachable to said body by keyed fastening means which enable said member to be attached to said body only in a predetermined fixed orientation with respect to said body, said member protruding rearwardly of said rear wall surface of said body, said trailing member having a longitudinally directed visual feature viewable from above said body.

2. The golf putter head of claim 1 wherein said visual feature of said trailing member is further defined as being perpendicular to said front face of said body.

3. The golf putter head of claim 1 wherein said visual feature of said trailing member is further defined as being a symmetry plane perpendicular to said front face of said body.

4. The golf putter head of claim 1 wherein said visual feature of said trailing member is further defined as being an index line directed perpendicularly to said front face of said body.

5. The golf putter head of claim 1 further including a second trailing member protruding rearwardly of said rear wall surface, said second trailing member being laterally spaced apart from said first trailing member and having a longitudinally directed visual feature viewable from above said upper wall surface.

6. The golf putter head of claim 5 wherein said first and second trailing members are located equidistant from a central region of said front face of said body defining a sweet spot of said body.

7. The golf putter of claim 6 wherein said visual feature of each of said first and second trailing members is further defined as being perpendicular to said front face of said body.

8. The golf putter of claim 6 wherein said visual feature of each of said first and second trailing members is further defined as being a symmetry plane perpendicular to said front face of said body.

9. The golf putter head of claim 6 wherein said visual feature of each of said trailing members is further defined as being an index line directed perpendicular to said front face of said body.

10. The golf putter head of claim 1 wherein said keyed fastening means is further defined as comprising in combination;

a. a first, head bore angled obliquely at a first angle inwardly into said rear wall surface of said body, b. a second, trailing member bore angled obliquely outwardly from a front face of said trailing member at a second angle equal to said first angle, and c. an elongated fastening member securable in said first and second bores.

11. The golf putter head of claim 10 wherein said elongated fastening member is further defined as being an externally threaded member.

12. A golf putter head comprising a laterally elongated body having an upper wall surface, a front face for impacting a golf ball, a first, outer longitudinally disposed side wall defining adjacent thereto a toe end portion of said body, a second, inner longitudinally disposed side wall defining adjacent thereto a heel end portion of said body, a rear wall surface, and a pair of laterally spaced apart trailing members each protruding rearwardly of said rear wall surface of said body, each of said trailing members being separately removably attachable to said body by first and second keyed fastening means which enable said members to be attached to said body only in a predetermined fixed orientation with respect to said body, each of said trailing members including a visual feature directed perpendicularly towards said front face of said body and viewable from above said body.

13. The golf putter head of claim 12 further including fastening means for removably fastening said trailing members to said body.

14. The golf putter head of claim 13 wherein said fastening means is further defined as comprising in combination a trailing member bore disposed in a generally longitudinal direction through said trailing member, a body bore penetrating said body, and an elongated member adapted to be insertably received in said respective bores and secured therein.

15. The golf putter head of claim 14 wherein said trailing member bore and said body bore are coaxial with a line angled away from a longitudinal center line through said trailing member.

16. The golf putter head of claim 15 wherein said body is further defined as having formed therein a pair of laterally opposed, inwardly protruding slots adapted to insertably receive a separate one of said trailing members.

17. The golf putter head of claim 15 wherein said elongated member is further defined as a screw.

18. The golf putter head of claim 12 wherein at least one of said pair of trailing members is further defined as comprising in combination a hollow, exterior shell, and a weighting member removably contained therewithin.

19. The golf putter head of claim 12 wherein said trailing members are further defined as being laterally elongated.

20. The golf putter of claim 12 wherein said trailing members are each further defined as having a lower surface substantially flush with said sole surface of said body.

21. The golf putter head of claim 12 wherein said keyed fastening means are each further defined as comprising in combination;

a. a first, head bore angled obliquely at a first angle inwardly into said rear wall surface of said body, b. a second, trailing member bore angled obliquely outwardly from a front face of said trailing member at a second angle equal to said first angle, and c. an elongated fastening member securable in said first and second bores.

22. The golf putter head of claim 21 wherein said elongated fasting member is further defined as being an externally threaded member.

23. In a golf putter head comprising a laterally elongated body having an upper wall surface, a front face for impacting a golf ball, a first longitudinally disposed, outer side wall defining inwardly thereof a toe end portion of said body, a second, inner longitudinally disposed side wall defining inwardly thereof a heel portion of said body, and a rear wall surface, the improvement comprising a pair of laterally spaced apart trailing members each protruding rearwardly of said rear wall surface of said body, each of said trailing members being separately removably attachable to said body by first and second keyed fastening means which enable said members to be attached to said body only in a predetermined orientation with respect to said body, said trailing members including a visual feature directed perpendicularly towards said front face of said body and viewable from above said body.

24. The improved golf putter head of claim 23 wherein each of said trailing members is further defined as having a laterally symmetric shape.

25. The improved golf putter of claim 24 wherein said trailing members are further defined as being equidistant from a vertical center plane of said body.

26. The improved golf putter of claim 25 wherein each of said trailing members has in plan view rearwardly converging side walls.

27. The improved golf putter of claim 26 wherein the plan view shape of each of said trailing members is further defined as approximating that of a triangle.

28. The improved golf putter of claim 27 wherein said triangle is further defined as being a isosceles triangle.

29. The improved golf putter of claim 23 wherein at least one of said pair of trailing members is further defined as being removably fastenable to said body.

30. The improved golf putter of claim 29 wherein at least one of said removable pair of trailing members is further defined as comprising in combination a hollow, exterior shell and a weighting member removably contained therewithin.

31. The improved golf putter of claim 30 wherein said trailing members are each further defined as having a lower surface substantially flush with said sole surface of said body.

32. The golf putter head of claim 23 wherein said first and second keyed fastening means are each further defined as comprising in combination;

a. a first, head bore angled obliquely at a first angle inwardly into said rear wall surface of said body, b. a second, trailing member bore angled obliquely outwardly from a front face of said trailing member at a second angle equal to said first angle, and c. an elongated fastening member securable in said first and second bores.

33. The gold putter head of claim 32 wherein said elongated fastening member is further defined as being an externally threaded member.

* * * * *